US008826629B1

(12) United States Patent
Brindle

(10) Patent No.: US 8,826,629 B1
(45) Date of Patent: Sep. 9, 2014

(54) APPARATUS AND METHOD FOR AN ADJUSTABLE COLUMN

(71) Applicant: David R. Brindle, Queensbury, NY (US)

(72) Inventor: David R. Brindle, Queensbury, NY (US)

( * ) Notice: Subject to any disclaimer, the term of this patent is extended or adjusted under 35 U.S.C. 154(b) by 0 days.

(21) Appl. No.: 13/844,546

(22) Filed: Mar. 15, 2013

(51) Int. Cl.
*E04C 3/00* (2006.01)

(52) U.S. Cl.
CPC ..... *E04C 3/005* (2013.01)
USPC ..... 52/745.17; 52/854; 52/831; 52/126.7; 52/855

(58) Field of Classification Search
CPC ..... E04C 3/00; E04C 3/005; E04C 3/30; E04C 3/32; E04H 12/22; E04H 12/2284
USPC ..... 52/854, 831, 126.7, 855, 745.17, 296; 248/161, 405; 254/102
See application file for complete search history.

(56) References Cited

U.S. PATENT DOCUMENTS 1,547,175 A * 7/1925 Lally ..... 52/301
1,571,091 A * 1/1926 Lally ..... 52/283
1,625,899 A * 4/1927 Lally ..... 52/260
2,280,220 A * 4/1942 Crosby ..... 52/126.6
2,763,342 A * 9/1956 French ..... 403/25
2,943,716 A * 7/1960 Babcock ..... 52/653.1
3,521,413 A * 7/1970 Scott et al. ..... 52/98
3,630,474 A * 12/1971 Minor ..... 52/98
3,671,738 A * 6/1972 Beachley ..... 362/431
3,837,752 A * 9/1974 Shewchuk ..... 403/2
3,967,906 A * 7/1976 Strizki ..... 403/2
4,007,564 A * 2/1977 Chisholm ..... 52/98
4,217,738 A * 8/1980 Smith ..... 52/40
4,295,308 A * 10/1981 Korfanta ..... 52/296
4,590,719 A * 5/1986 McKibbin ..... 52/116
4,878,160 A * 10/1989 Reneau et al. ..... 362/269
4,926,592 A * 5/1990 Nehls ..... 52/98
5,056,750 A * 10/1991 Ellithorpe ..... 248/354.3
5,156,395 A * 10/1992 Smith ..... 473/483
5,505,033 A * 4/1996 Matsuo et al. ..... 52/296
5,660,362 A * 8/1997 Selby et al. ..... 248/188.4
5,772,356 A * 6/1998 Collins ..... 403/343
5,855,443 A * 1/1999 Faller et al. ..... 403/2
5,878,540 A * 3/1999 Morstein ..... 52/296
6,820,389 B1 * 11/2004 Macchietto ..... 52/835
6,868,641 B2 * 3/2005 Conner et al. ..... 52/98
7,677,522 B2 * 3/2010 Bakos ..... 248/500
2003/0194280 A1 10/2003 Calhoun
2005/0045784 A1 * 3/2005 Pitlor ..... 248/206.5
2005/0056760 A1 3/2005 Carlson
2010/0129147 A1 5/2010 Wrightman

* cited by examiner

*Primary Examiner* — Mark Wendell
(74) *Attorney, Agent, or Firm* — Harold G. Furlow, Esq.

(57) ABSTRACT

An adjustable column apparatus is described which includes a column, a cap plate and an adjustment mechanism. The cap plate and adjustment mechanism are connected to the column and fasteners are used to connect the cap plate to an external beam. The assembled column, cap plate and adjustment mechanism are suspended from the beam by the fasteners. The adjustment mechanism is adjusted to provide a load bearing interface between a floor and the column.

13 Claims, 12 Drawing Sheets

APPARATUS AND METHOD FOR AN ADJUSTABLE COLUMN

CROSS-REFERENCE TO RELATED APPLICATIONS

This application is a continuation in part of and claims priority to U.S. patent application Ser. No. 12/473,301 filed May 28, 2009 that is a continuation in part of and claims priority to U.S. patent application Ser. No. 12/156,155 filed May 29, 2008, the disclosures of which are incorporated by reference herein and made part of this application.

BACKGROUND OF THE INVENTION

1. Field of the Invention

The present disclosure relates to columns used to support structures and in particular to columns that can be adjusted in height.

2. Description of the Related Art

Permanent structural columns, such as columns, are often pre-fabricated and cut to size at the construction site to fit the actual height needed for a particular application. The cutting, assembling and installing of the column is a time consuming process that can undesirably require specialized tools and skilled labor.

Adjustable columns that have been developed to address this problem are typically telescopic in nature with a first tubular post sliding within a second tubular post. A cross-bar is inserted through holes aligned in the first and second posts to fix the height of the column. A cap plate is connected to a threaded bar and the bar is then rotated to elevate the cap plate for the final height adjustment. These adjustable columns, however, can be load limited compared to traditional columns and are vulnerable to tampering. Alternative adjustable columns insert one or more shim plates at the base to increase the height of the column while the column is manually held upright for connection with pre-existing apertures in a beam. Both of these configurations require multiple personnel to retain the column in position while the height of the column is adjusted and the alignment secured.

Columns have traditionally been assumed to support a load that also provides an adequate counterforce against uplifting forces. This tradition is incorporated into many residential and commercial building codes by the omission of a requirement that columns connect to the floor and supported beam. As a result, in many installations columns are simply placed in a load bearing position without being positively secured to the floor and beam. A secure connection between the column, floor and beam that can provide the uplift protection is being increasing recognized as an important structural element under severe weather or environmental conditions.

An adjustable column is needed that can be readily installed by a single worker with the use of readily available tools that can also advantageously provide uplift protection.

SUMMARY OF THE INVENTION

An adjustable column is described that comprises a tubular column that has a first end portion and an opposed second end portion. The first end portion includes a plate positioned inside of and connected to the tubular walls of the column. The plate or column plate is recessed below a rim of a first end portion of the column. The column plate defines an aperture.

A cap plate has a first side and an opposed second side. The first side of the cap plate is fixed to the column and the opposed second side of the cap plate is adapted to interface with a beam. The cap plate defines a receptacle that is a countersink that has a tapered structure that defines a first aperture. A first fastener with a countersunk head is received by and mates with the countersink in the cap plate. The first fastener installed in the countersink includes a top of the head of the first fastener approximately flush with the second side of the cap plate. The cap plate adapted to secure the column to the beam. The cap plate defines second apertures and includes second fasteners that are positionable in the second apertures that are adapted to secure the cap plate to the beam.

An adjustment mechanism connects to the second end portion of the column. The adjustment mechanism includes a base plate, a base flange and a threaded rod. The base plate is fixedly connected to the threaded rod. The base flange defines a threaded aperture that connects with the threaded rod to adjust the height of the column. The base plate is adapted to be positioned on a floor. The base flange is connected to the second end portion of the column. The cap plate is connected to the beam and the column is suspended from the cap plate. The second end portion of the column is adapted to provide an adjustable load bearing interface between the floor and a terminal end of the second end portion of the column. The adjustment mechanism adjusts to extend between the suspended column and the floor. The extended adjustment mechanism is adapted to place the column in a load bearing position between the beam and floor.

The cap plate can have a structure that includes a base that is connected to two approximately parallel sidewalls. The cap plate has an approximately U-shape that is adapted to receive the beam between the sidewalls. The countersink defined in the cap plate includes multi-sided walls. The head of the fastener has mating multi-sided walls that engage and fix the head of the first fastener from rotational movement in the countersink receptacle. The second apertures are defined in the sidewalls of the cap plate.

The countersink structure in the cap plate in combination with, the flat headed countersink first fasteners provide a flush alignment with the second side of the cap plate and a flat mating surface that is adapted to fit flush against a bottom of the beam. This combination is adapted to provide a compact secure fit between the cap plate and the beam. The single first fastener provides a simplified direct attachment between the cap plate and the first end portion of the column. Similarly, the single threaded rod of the adjustment mechanism advantageously provides a simplified and direct adjustable attachment between the base plate and the base flange.

BRIEF DESCRIPTION OF THE DRAWINGS

Preferred embodiments of the invention are described below with reference to the drawings, wherein like numerals are used to refer to the same or similar elements.

DETAILED DESCRIPTION OF THE INVENTION

Figure 1:
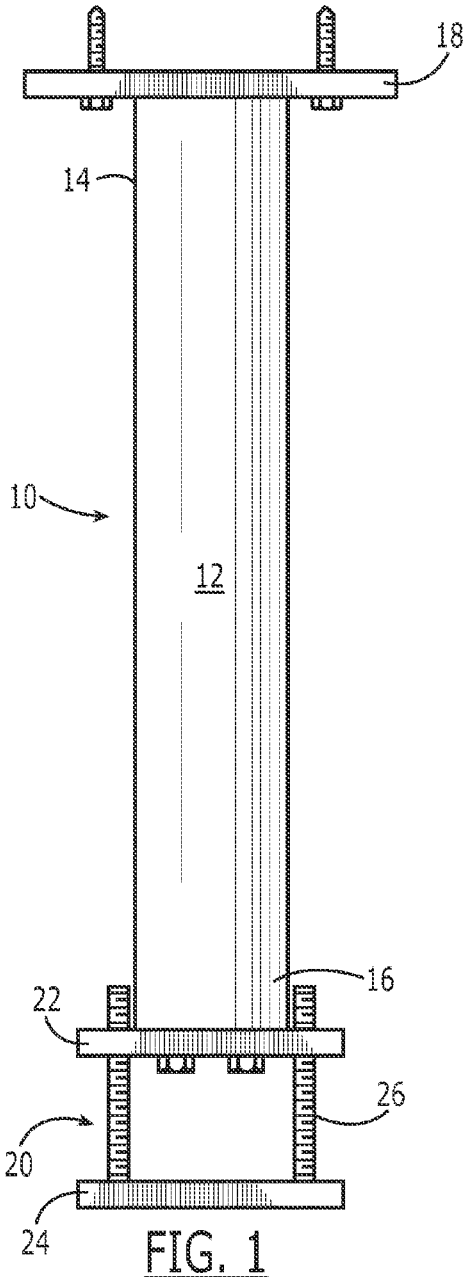
FIG. 1 is a front view of an adjustable column that includes a column, a cap plate and an adjustment mechanism, the adjustable column constructed in accordance with the present disclosure.

Referring initially to FIG. 1, an apparatus for an adjustable column 10 includes an elongate column 12 that has a first end portion 14 and an opposed second end portion 16, a cap plate 18 and an attachment mechanism 20. First end portion 14 connects to cap plate 18 and second end portion 16 connects to adjustment mechanism 20. Column 12 defines a central longitudinal axis and preferably has a cylindrical shape. In this preferred embodiment, column 12 is an exemplary lally type column.

Figure 2:
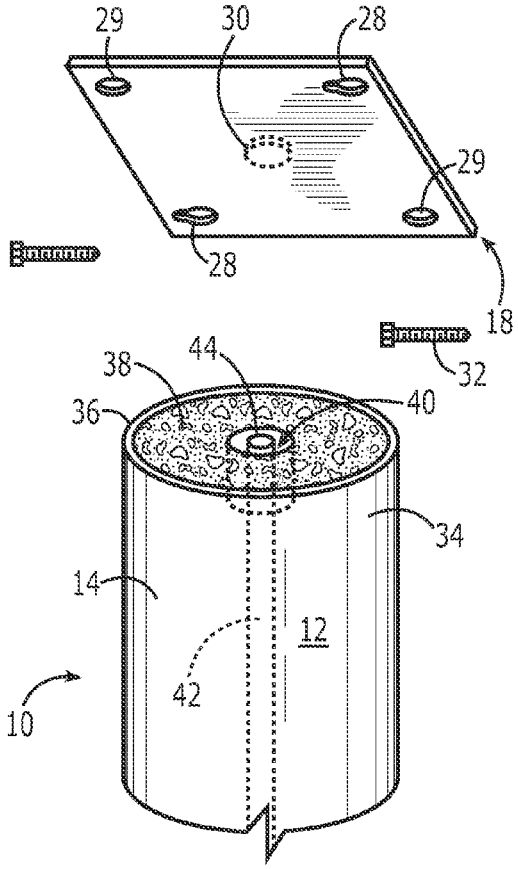
FIG. 2 is a top and side perspective view of a first end portion of the column and a perspective view of a first side of the cap plate of the adjustable column of FIG. 1.

As shown in FIG. 2, cap plate 18 is a planar shaped plate that defines at least two key hole type apertures 28 that are selective retention mechanisms for cap plate 18 with fasteners 32. In addition, cap plate 18 can selectively define one or more apertures 29 that are cylindrical shaped through holes. A receptacle or nut 30 is connected to a first side of cap plate 18. In this preferred embodiment, nut 30 interfaces with an anchor bolt 42 that is preferably a ½ inch diameter threaded bolt. The opposing side of cap plate 18 is adapted to interface with an external structure. In this preferred embodiment, cap plate 18 is an approximately 5⅜% inches wide, approximately eight (8) inches long and approximately ¼ of an inch thick plate.

Key hole apertures 28 have a first portion and a second portion. The first portion of each aperture 28 has a first cross-sectional area parallel to the plane defined by plate 18 that tapers or reduces to a second portion with a second cross-sectional area parallel to the plane of plate 18 in the second portion. The first portion of aperture 28 has a larger cross-sectional area than the cross-sectional area of the second portion. Bolts 32 have heads that will fit through the first portion, but cannot fit through the reduced area of the second portion of key hole apertures 28. Key hole apertures 28 are preferably aligned in a single direction, but it is understood that apertures 28 can have any directional alignment that facilitates the securing and retaining of cap plate 18 to the external structure.

Alternative equivalents of the selective retention mechanism of cap plate 18 or means for selectively retaining plate 18 with fasteners 32 includes configurations in which select apertures in cap plate 18 allow the passage of a head of fastener 32 and a slotted washer, pin and/or slotted plate is positioned between cap plate 18 and the head of fastener 32 to retain cap plate 18 with the head of fastener 32.

Column 12 is preferably a Lally type column that has a steel outer tube 34 that defines a rim 36 that is a portion of the terminal end of first end portion 14 of column 12. Column 12 includes a concrete filling 38 with a terminal end that is approximately flush with rim 36. First end portion 14 includes a notch or aperture 40 in an outwardly directed face of the terminal end of concrete 38 that extends a predetermined distance along and is aligned with the central longitudinal axis of column 12. An anchor bolt 42 is positioned in concrete filling 38 that extends into notch 40 and in the opposing direction along the central longitudinal axis towards second end portion 16. Column 12 has an outside diameter in this exemplary preferred embodiment that is approximately four (4) inches in diameter.

Notch 40 has a depth along the central longitudinal axis and cross-sectional area perpendicular to the longitudinal axis that receives nut 30 of plate 18. Bolt 42 has a first terminal end 44 that is approximately aligned with rim 36 of tube 34. Anchor bolt 42 and nut 30 secure the first side of cap plate 18 in direct contact with the terminal end of first end portion 14. Anchor bolt 42 provides the structural integrity necessary for bolt 42 to provide uplift protection and at least support the weight of adjustable column 10.

Figure 3:
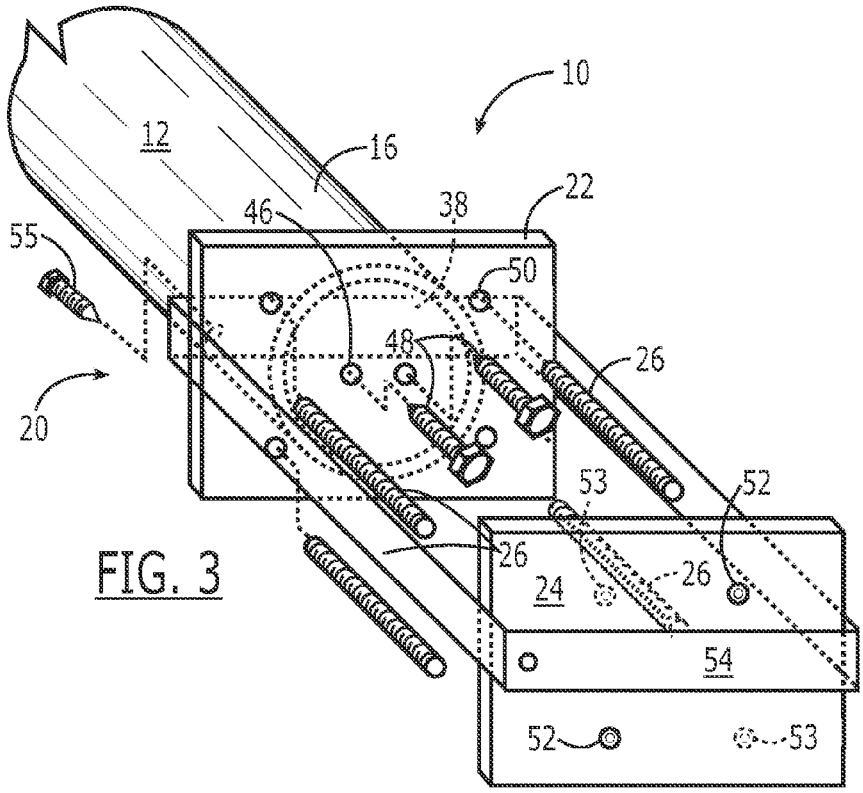
FIG. 3 is a bottom and side perspective view of a first embodiment of the adjustment mechanism of the adjustable column of FIG. 1.

Referring now to FIGS. 1 and 3, in this preferred embodiment of adjustment mechanism 20 includes a base flange 22, a base plate 24 and four load bearing fasteners 26. Base flange 22 connects to second end portion 16 of column 12. Base flange 22 preferably defines two apertures 46 that receive concrete screws 48 that secure base flange 22 to concrete filling 38 of the terminal end of second end portion 16. It is understood that alternative methods of connecting flange 22 and column 12 include those commonly used in the industry such as welding, adhesives and/or an anchor bolt, for example.

Base flange 22 has four apertures 50 that are in close proximity to the outer surface of column 12. Apertures 50 have an equidistant arrangement that form a square around column 12. Each fastener 26 has a head and an opposed distal or second end. Each fastener 26 is preferably a hardened set screw suitable for load bearing applications of adjustable column 10 and to provide for the relative movement between base flange 22 and base plate 24. Fasteners 26 preferably have a diameter of ½ inch and a length of approximately 3½ inches.

Continuing with this preferred embodiment, base plate 24 includes two diagonally opposed apertures 52 and two diagonally opposed notches 53 that are aligned with apertures 50. Fasteners 26, apertures 50, apertures 52 and notches 53 are aligned with the central longitudinal axis. Apertures 52 can be through holes or terminate in plate 24. Two fasteners 26 are connected to both threaded apertures 50 in base flange 22 and threaded apertures 52 in base plate 24 to securely couple base flange 22 to base plate 24. The remaining two fasteners 26 are connected to threaded apertures 50 and the distal end of each fastener 26 is positioned in one of notches 53. Notches 53 are non-threaded depressions in plate 24 that are sized and dimensioned to receive the second end of fasteners 26.

Uplift protection for adjustable column 10 is provided by securing attachment mechanism 20 to an external structure. Fasteners such as concrete screws 48 connect to the external structure through additional apertures in base plate 24. Fasteners 26 can also extend through apertures 52 in base plate 24 and have terminal ends suitable to connect with an external structure.

In a variation of the first embodiment of adjustment mechanism 20, base plate 24 includes four notches 53 that receive the second ends of fasteners 26. This variation provides an increased ability to compensate for angular variations in the external surface upon which base plate 24 is positioned. Base plate 24 is connected to base flange 22 by a band 54. In this variation, band 54 preferably extends under base plate 24 and is secured to base flange 22 using screws 55. Band 54 is preferably metal, but band 54 can be fabricated of alternative materials such as composites, polymers and fiberglass, for example, that connect base flange 22 and base plate 24 together in a secure load bearing position.

Figure 6:
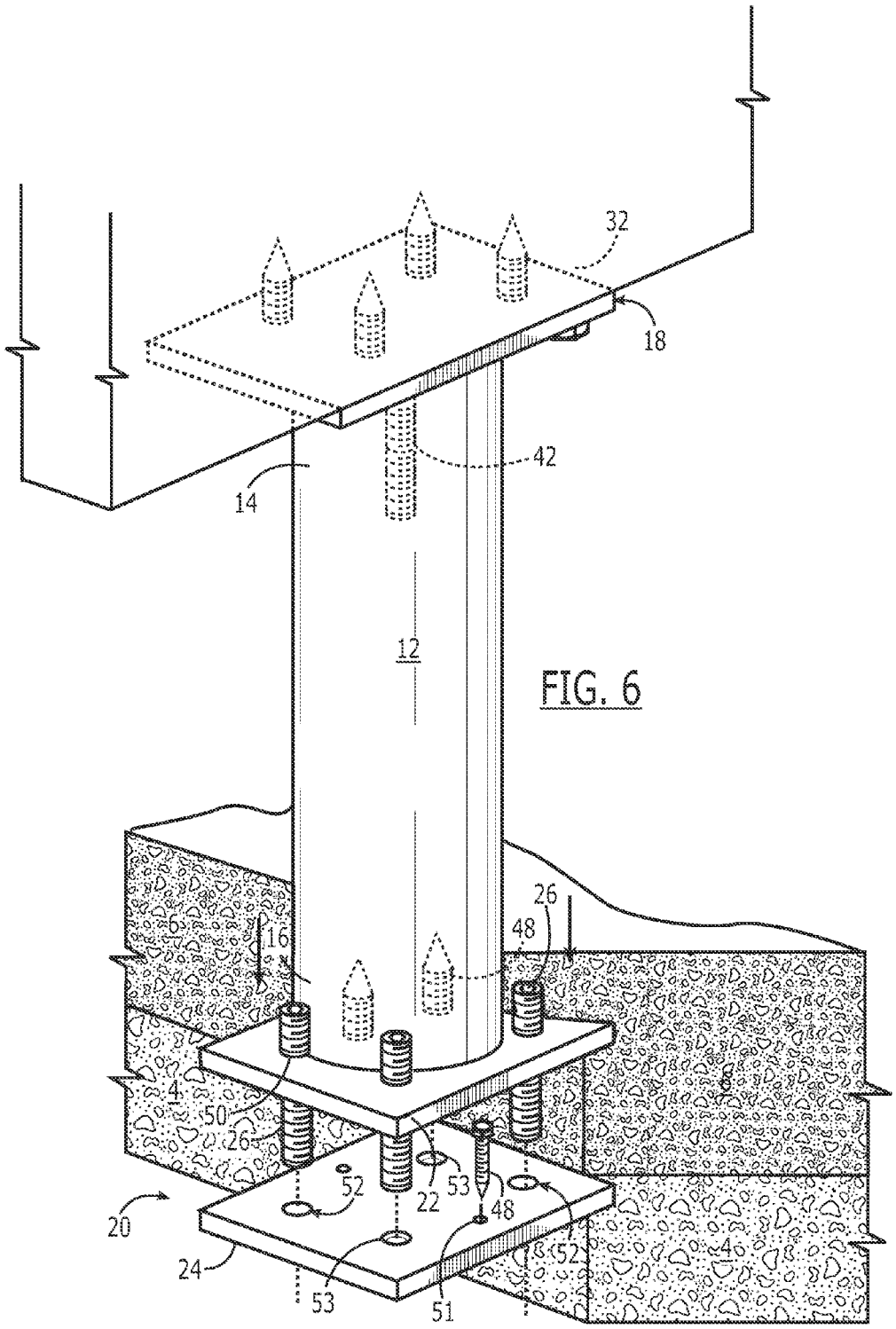
FIG. 6 is a close-up front and downwardly directed perspective view of the adjusting of the height of the adjustable column of FIG. 1 into a load bearing position.

Continuing with this variation of the first embodiment, uplift protection is provided by the embedding of adjustment mechanism 20 in a layer of poured concrete such as concrete floor 6 (see FIG. 6). Uplift protection can be also provided by using one or more concrete screws, such as fasteners 48 through additional holes in plate 24 and/or band 54 and into an external surface such as sub-floor 4, for example (see FIG. 6).

Figure 4:
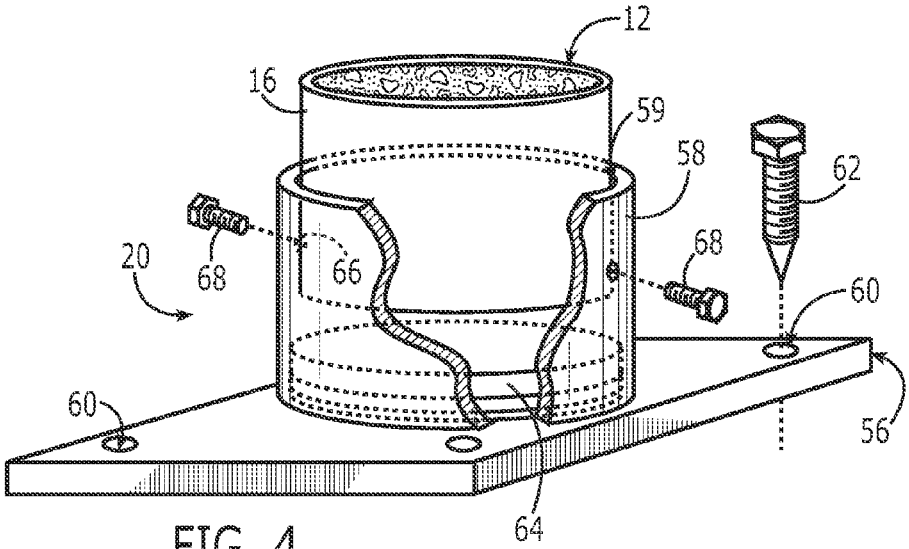
FIG. 4 is a side and top perspective view of a second embodiment of the adjustment mechanism of the adjustable column of FIG. 1.

As shown in FIG. 4, a second preferred embodiment of adjustment mechanism 20 includes a base plate 56 and a sleeve 58. Plate 56 has two or more apertures 60 that receive fasteners 62, such as concrete screws that connect plate 56 to an external surface for uplift protection. Sleeve 58 connects to base plate 56 and defines an aperture 59 that receives column 12.

The second embodiment of adjustment mechanism 20 also includes a set of discs 64 that has a plurality of individual discs that range in thickness between approximately 1/16 of an inch and approximately one (1) inch. Set of discs 64 preferably has planar parallel opposing faces and an outside diameter that is approximately equivalent to the outside diameter of column 12. At least one of set of discs 64 is selectively positioned on base plate 24 to provide a continuous load bearing interface between the terminal end of second end portion 16 of column 12 and base plate 56. A recess is preferably defined in base 56 that receives and aligns the initial disc of set of discs 64 with the connection for sleeve 58.

Sleeve 58 connects to second end portion 16 of column 12 and flange 56 to align column 12 with set of discs 64 and create an integrated assembly of attachment mechanism 20 and column 12. Sleeve 58 encloses set of discs 64 between base plate 56 and the terminal end of second end portion 16 of column 12. Sleeve 58 can connect to base plate 56 and column 12 using any means of mechanical connection that provides adequate uplift protection. In this preferred embodiment, sleeve 58 is secured to column 12 by at least one aperture 66 in sleeve 58 that receives a fastener 68 that extends through tube 34 and into concrete filling 38.

Base plate 56 preferably has dimensions of approximately 5¾ by 8 inches and a thickness perpendicular to the longitudinal axis of approximately % of an inch. Sleeve 58 has a height along the longitudinal axis of approximately four inches and a thickness perpendicular to the longitudinal axis of approximately ¼ inch. Aperture 59 of sleeve 58 has an inside diameter of approximately four (4) inches that receives a four (4) inch diameter lally column 12. It is understood, however, that these dimensions are variables that are situational dependent upon interfacing with a given dimension of column 12 for a specified structural application.

Referring to FIGS. 3 and 4, adjustment mechanism 20 preferably has a range of adjustability that is adapted to a particular column 12 and load capacities. For example, in one preferred embodiment, columns 12 can be procured in lengths that vary by three inches. The adjustable range of extension or adjustment mechanism 20 in this example is approximately 3 inches depending upon factors such as the thickness of base flange 22 and which embodiment is employed.

Cap plate 18, base flange 22, base plate 24 and base plate 56 are preferably planar shaped steel plates that can be dimensioned to a particular application and to increase the level of uplift protection. For example, increasing the dimensions of base flange 22 and base plate 24 increases the surface area of the interface and potentially distributes the load of adjustment mechanism 20 with an external structure.

Fasteners 48, 62 and 68 are fasteners that are appropriate for use with the material with which they interface. For example, fasteners 48, 62 and 68 are preferably hardened screws for connecting to concrete, but the fasteners can also include attaching nuts and other connecting devices depending upon the application. Similarly, anchor bolt 42 is a hardened bolt that preferably includes a retention aiding device that is embedded in concrete 38. The fasteners, to include fasteners 26, 32 and bolt 42 of adjustable column 10, have the load capacity to perform the desired functions defined herein.

Referring now to FIG. 1 adjustable column 10 can be assembled and installed advantageously by a single unskilled worker as an apparatus that includes column 12, cap plate 18 and adjustment mechanism 20. Select components such as cap plate 18, base flange 22 and/or base plate 24, for example, can be manufactured and assembled in the field as adjustable column 10.

Figure 5:
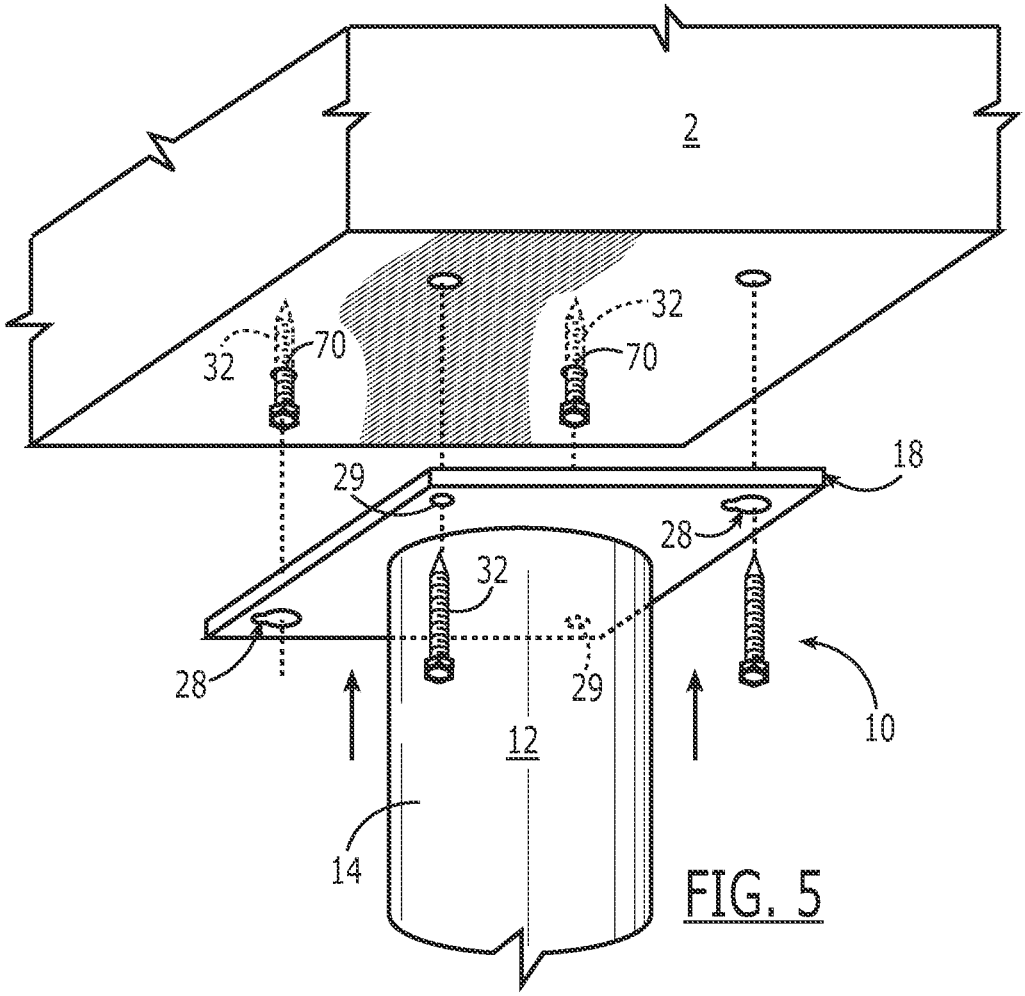
FIG. 5 is a front and upwardly directed perspective view of the connecting of the adjustable column of FIG. 1 to an external beam.

As shown in FIGS. 2 and 5, cap plate 18 is preferably operationally employed as a template and two apertures 70 are made in an external structure such as beam 2 that are aligned with key hole apertures 28. At least two fasteners 32 are screwed into beam 2 and a gap is left between the heads of fasteners 32 and beam 2 that can receive the thickness of cap plate 18. Beam 2 is made of industry standard materials such as wood, wood products, concrete or steel and due to their varying materials it is understand that there are application specific alternative processes for connecting a support structure, such as fasteners 32, to beam 2 for the suspension of column 12. Some of these alternative support structures for beam 2 can include, for example, a metal strap, drilling holes and using standard fastener mechanisms such as bolts and nuts, welding or an adapter plate, for example, that has fasteners that connect to cap plate 18 as well as other alternative mechanical connection means.

Nut 30 is connected to anchor 42 in first end portion 14 to secure cap plate 18 to column 12. Nut 30 recesses into aperture 40 defined in concrete filling 38. This connection advantageously provides a continuous load bearing interface between plate 18 and the terminal end of first end portion 14. The opposing side of cap plate 18 from nut 30 is adapted to interface with beam 2.

Referring now to FIGS. 3, 5 and 6, in the first embodiment of adjustment mechanism 20, base flange 22 is connected to second end portion 16. Fasteners 26 are threaded through apertures 50 and threaded into apertures 52 or positioned in notches 53. The height of adjustment mechanism 20 is adjusted by turning fasteners 26 that interface with notches 53 to change the height between base flange 22 and base plate 24.

The height of distance between base flange 22 and base plate 24 is initially adjusted so that there is sufficient clearance between base plate 24 and a floor, such as a subfloor 4 or floor 6, to accommodate the raising and connecting of adjustable column 10. In this preferred embodiment this can also include leaving sufficient height clearance for a lever to be inserted under adjustable column 10. It is understood that the load capacity, size and number of fasteners 26 as well as the number of apertures 50, apertures 52 and notches 53 can vary depending upon an intended application of adjustable column 10.

Adjustable column 10 is then raised and temporarily held in an approximately vertical position aligned with fasteners 32 in beam 2. A lever is positioned under adjustment mechanism 20 and actuated to raise adjustable column 10 to pass the heads of preferably two fasteners 32 through the first portions of key hole apertures 28 of cap plate 18. Adjustable column 10 is repositioned to secure the heads of fasteners 32 in the second portion of key holes 28. As required, a safety plug or adapter can be additionally inserted into the first portions of key hole 28 to ensure that adjustable column 10 does not shift during the installation process. Adjustable column 10 is then freely hanging from the connection of fasteners 32 with beam 2. Additional fasteners 32 are employed through the remaining apertures 28 and/or 29 of cap plate 18 to secure adjustable column 10 to beam 2 at a desired alignment.

In this preferred embodiment utilizing four fasteners 26, a first pair of diagonally opposed fasteners 26 is threaded into apertures 50 of base flange 22 and into threaded apertures 52 of base plate 24. The first pair of fasteners 26 preferably terminates in apertures 52. The remaining pair of diagonally opposed fasteners 26 is threaded through apertures 50 and each fastener 26 terminates in its respective notch 53 of base plate 24. The second pair of fasteners 26 is employed to move base plate 24 relative to base flange 22 and into direct contact with sub-floor 4 and place adjustable column 10 into a load bearing position between beam 2 and sub-floor 4. Base plate 24 can also be adjusted to compensate for minor slope variations in sub-floor 4.

Attachment mechanism 20 is secured to subfloor 4 by connecting fasteners 48 through apertures in base plate 24 to secure adjustable column 10 to subfloor 4. Fasteners 26 that include a concrete screw second end portion can be optionally extended through apertures 52 and into pre-drilled apertures in subfloor 4 to provide additional uplift protection. Once adjustable column 10 is fixed in a load bearing position between beam 2 and subfloor 4, concrete floor 6 is poured to encase adjustment mechanism 20. The encasing of adjustment mechanism 20 includes the area between plates 22 and 24 and preferably overlays fasteners 26 below the floor level. The encasing of adjustment mechanism 20 advantageously provides additional uplift protection, sets adjustable column 10 at a permanent height and precludes tampering.

In an alternative embodiment of attachment mechanism 20, base flange 22 is connected to second end portion 16. Adjustable column 10 is raised vertically and connected to beam 2 as described previously by a single person. In this preferred embodiment, base plate 24 is positioned on subfloor 4 and the four fasteners 26 are threaded through apertures 50 of base flange 22 and each fastener 26 is aligned with a notch 53. Fasteners 26 are extended into notches 53 to adjust the height of adjustable column 10 and positioning adjustable column 10 in a load bearing position by moving base flange 22 relative to base plate 24. Uplift protection is provided by band 54 that is positioned under base plate 24 and connects to base flange 22 as described previously. Additional fasteners can extend through base plate 24 and/or base plate and band 54 to connect adjustment mechanism 20 to subfloor 4 to provide uplift protection. Adjustment mechanism 20 is then overlaid with floor 6 as described above.

Alternatively, base plate 24 of adjustment mechanism 20 can be positioned on and secured directly to floor 6. In this application, the gap between plates 22 and 24 is filled with grout. Adjustment mechanism 20 can be further encased in concrete, as desired. As noted above, fasteners 48 are employed through apertures in base plate 24 and directly into floor 6 to provide uplift protection.

Figure 7:
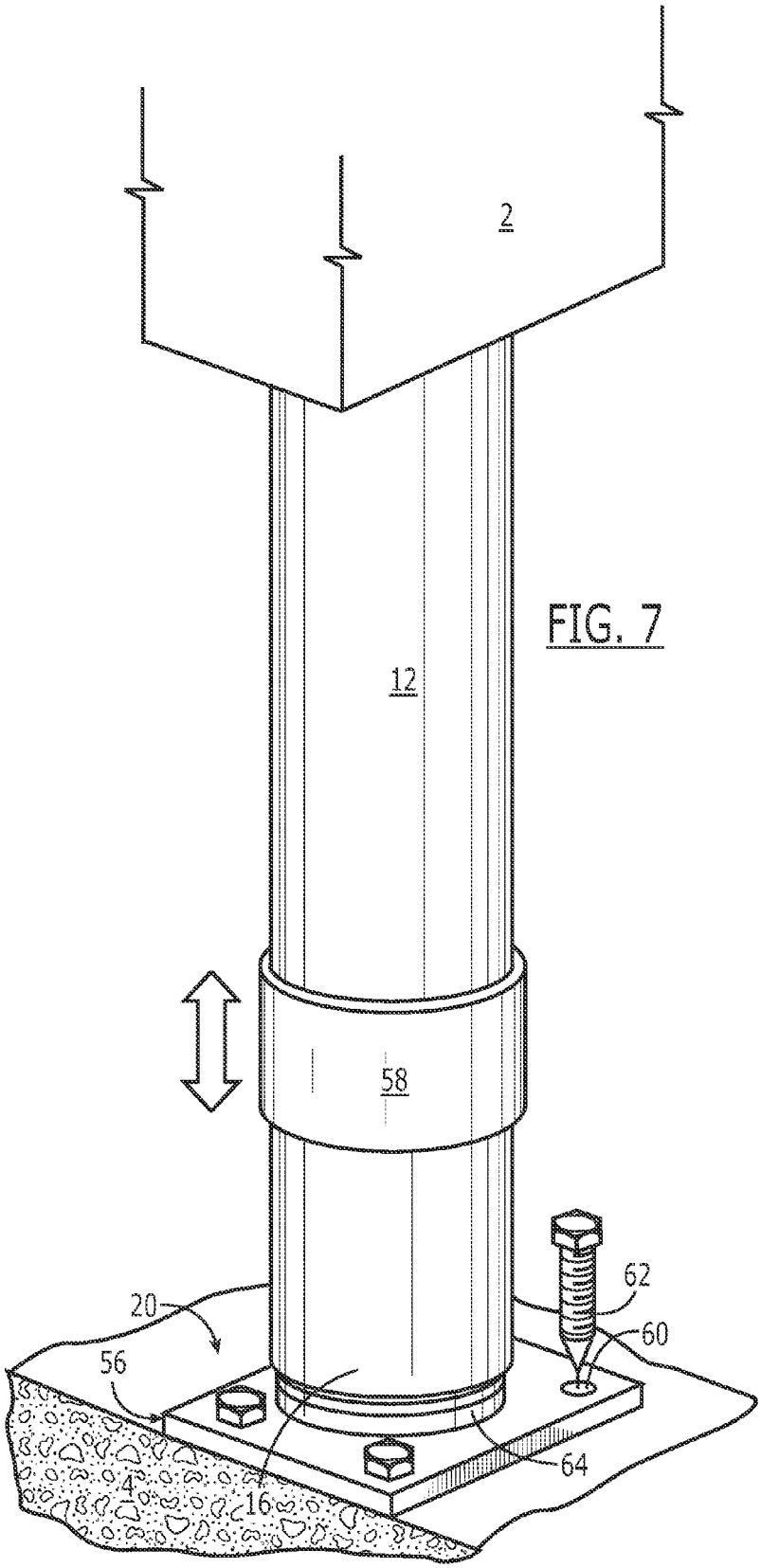
FIG. 7 is a front and downwardly directed perspective view of the adjusting of the height of the adjustable column and adjustment mechanism of FIG. 4 into a load bearing position.

As shown in FIGS. 4, 5 and 7, the operational employment of the second embodiment of adjustment mechanism 20 of adjustable column 10 includes the alignment of cap plate 18 and base plate 56. Cap plate 18 is secured to column 12 and fasteners 32 to beam 2. Sleeve 58 is slidingly connected onto column 12. Adjustable column 10 is raised approximately vertical and connected to beam 2 as described previously. Base plate 56 is aligned with column 12 and secured onto subfloor 4 by connecting fasteners 62 into subfloor 4 through apertures 60 of base plate 56.

Figure 8:
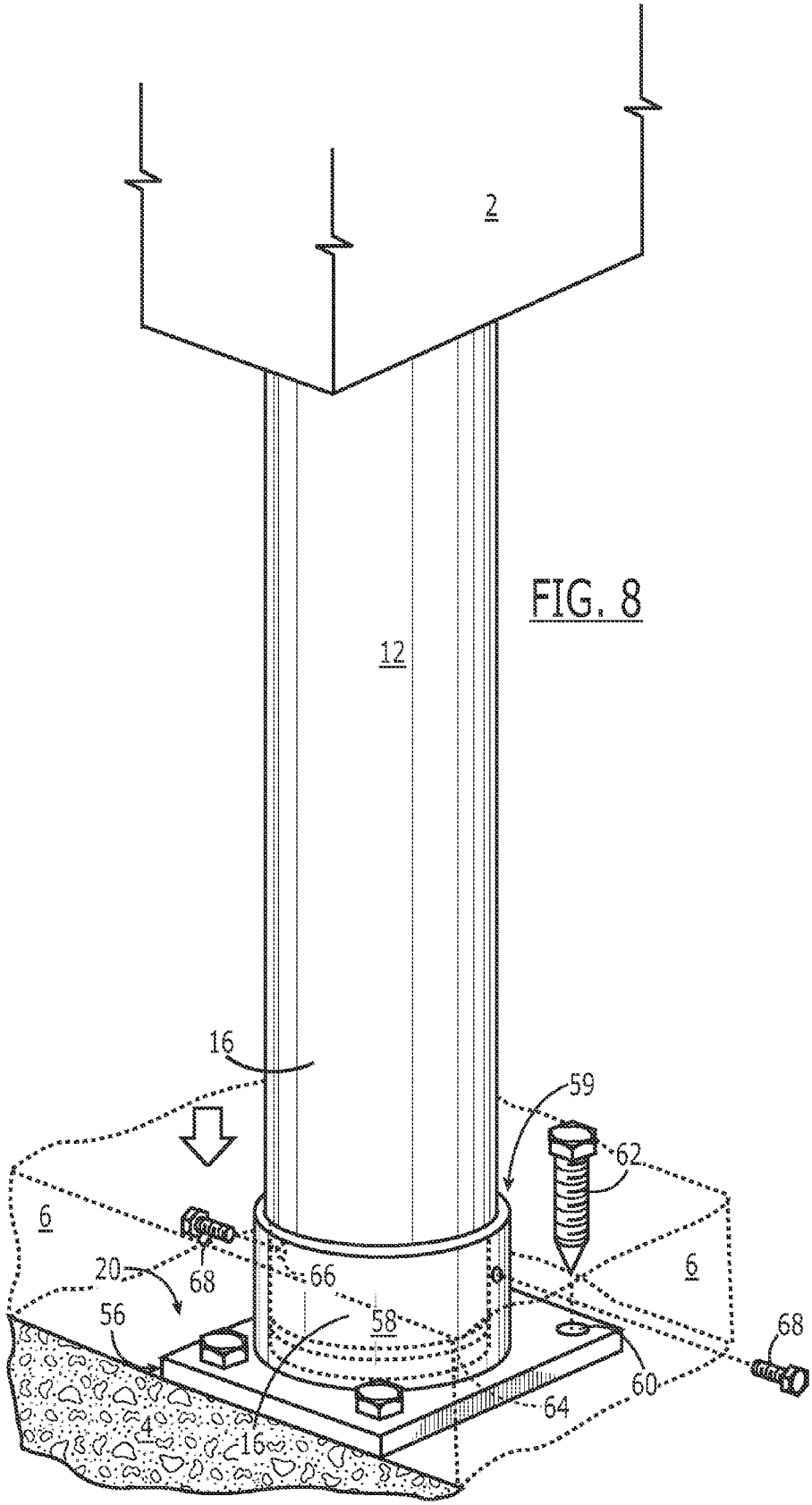
FIG. 8 is a front and downwardly directed perspective view of the adjustable column and adjustment mechanism of FIG. 7 in a load bearing position.

Referring now to FIGS. 7 and 8, one or more individual discs from set of discs 64 are selectively inserted to fill the gap between base plate 56 and the terminal end of second end portion 16 of column 12. The set of discs 64 is aligned with column 12 and sleeve 58 is slid down column 12 and connected with base plate 56. The means of connection between sleeve 58 and flange 56 can be a permanent coupling such as welded joint or alternatively a removable connection such as a threaded or a bolted interface. Specific examples of equivalents include a flange 56 that has an outer sleeve secured with fasteners to sleeve 58 or a sleeve 58 that includes a flange aligned with flange 56 and apertures that receive two or more concrete screws, such as concrete screws 64 that connect sleeve 58 to at least flange 56.

In the preferred embodiment, fasteners 68 connect column 12 and sleeve 58 through apertures 66. The apertures in column 12 that receive fasteners 68 can be one of a plurality of apertures that are predrilled in column 12 or apertures that are drilled on site during installation. The second embodiment of adjustment mechanism 20 can then be selectively encased in concrete to provide additional uplift protection and preclude tampering.

Figure 9:
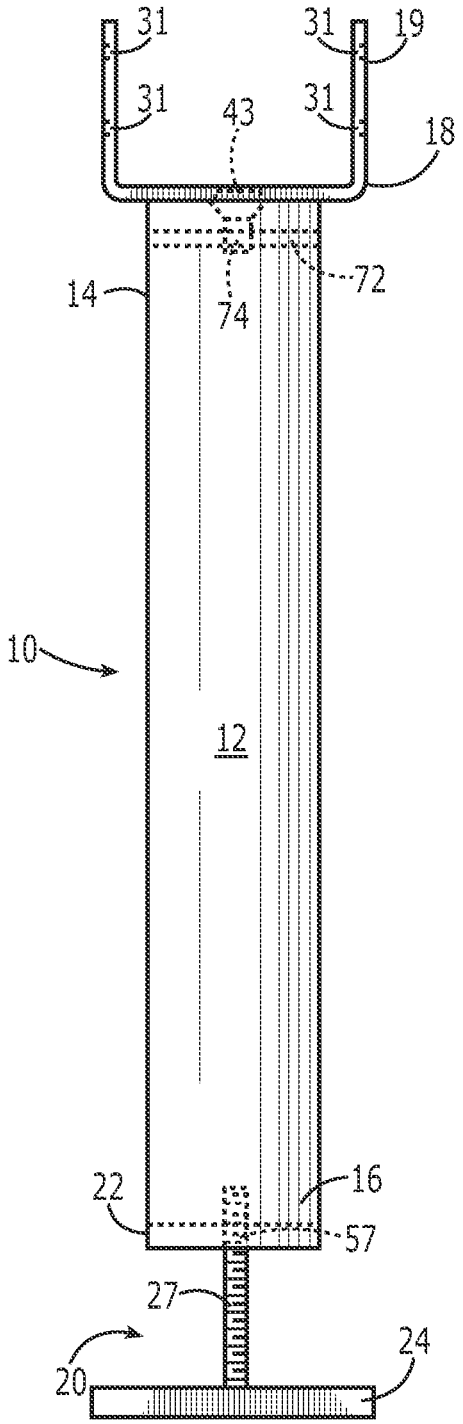
FIG. 9 is a front view of an another embodiment of an adjustable column.

Referring to FIG. 9 and another embodiment of adjustable column 10, adjustable column 10 includes elongate tubular column 12, cap plate 18 and attachment mechanism 20. Column 12 includes first end portion 14 and opposed second end portion 16. Column 12 has a tubular wall with an outer cylindrical shape that defines a central longitudinal axis aligned with a centerline of column 12. In this preferred embodiment, column 12 has an approximately $1/8^{th}$ inch thick tubular wall and an approximately three (3) inch diameter. Column 12 is preferably made of steel. It is understood that the structure and materials of construction of column 12 can vary depending upon factors such as the load and the dimensions of beam 2.

First end portion 14 connects to cap plate 18 and second end portion 16 connects to adjustment mechanism 20. First end portion 14 includes a plate 72 that is approximately perpendicular to the longitudinal axis defined by column 12. Plate 72 is preferably positioned approximately 3/8 of an inch below rim 36. Plate 72 defines a threaded aperture 74 that is aligned with center longitudinal axis of column 12.

Attachment mechanism 20 includes base flange 22, threaded rod 27 and base plate 24. Second end portion 16 connects to base flange 22. Base flange 22 defines a threaded aperture 57 that is aligned with centerline of column 12. Threaded rod 27 is fixed to base plate 24 and is adjustably connected through aperture 57 to base flange 22. Rod 27 is preferably an approximately 1¼$^{th}$ (1.25) inch threaded rod. Rod 27 preferably includes a lower section in proximity to base plate 24 that is unthreaded and includes flattened sides that are adapted to receive a wrench or other device to facilitate turning rod 27. It is understood that dimensions of rod 27, such as the length and diameter can vary depending upon the intended application.

Figure 10A:
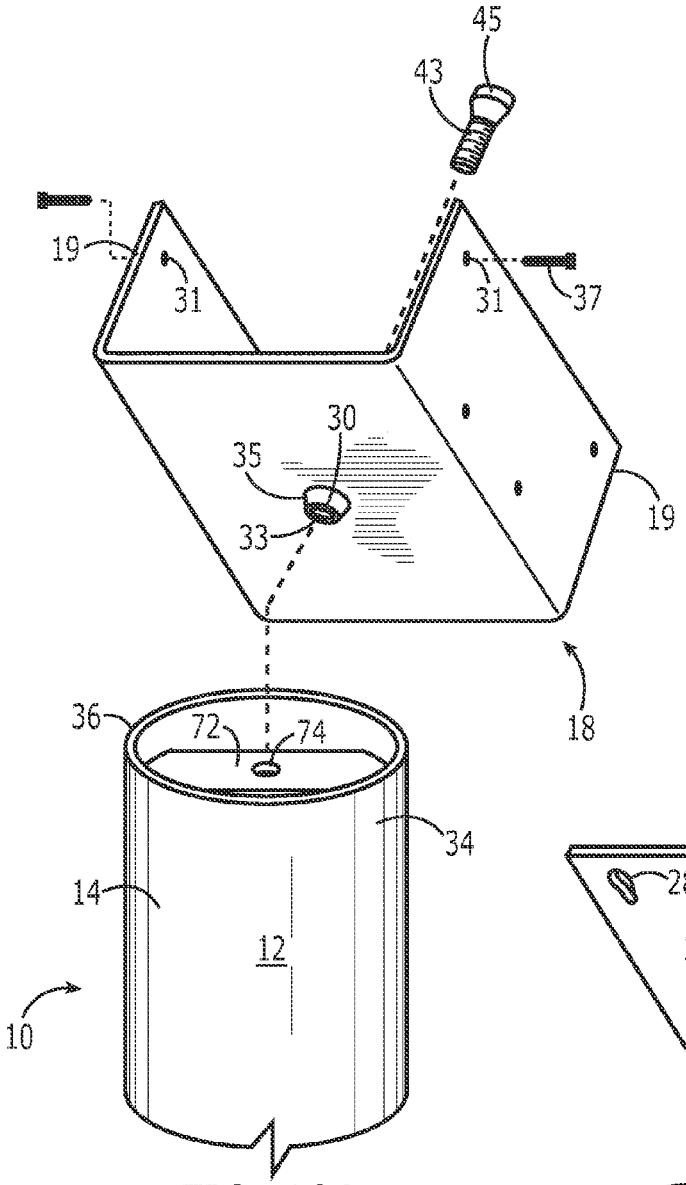
FIG. 10A is a top perspective view of a first end portion of the column and a first cap plate of the adjustable column of FIG. 9.

As shown in FIGS. 9 and 10A, cap plate 18 has an approximately U-shape. Cap plate 18 includes an approximately flat base plate connected to two approximately parallel sidewalls 19 positioned in fixed spaced separation that define the U-shape. The parallel sidewalls 19 extend approximately perpendicular to base plate of plate 18. The base plate includes a receptacle 30. Receptacle 30 defines an aperture 33 and has a tapered countersink 35 type shape that extends approximately perpendicular to base plate 18 and in a direction opposed to that of sidewalls 19. Aperture 33 is approximately aligned with the center longitudinal axis of column 12 and is preferably unthreaded. Countersink 35 receives a bolt 43 that is preferably an approximately ½ inch diameter threaded bolt. Bolt 43 has a multi-sided head that mates with the corresponding multi-sided inside surface of countersink 35 to securely connect bolt 43 and cap plate 18. Threaded bolt 43 also has a flat countersink head 45 when positioned in countersink 35 such that a top of the flat head 45 of bolt 43 is approximately flush with the second side of base plate 18.

Sidewalls 19 define apertures 31 that receive fasteners 37 that can be nails and/or screw type connectors. The opposing side of cap plate 18, to include the inner opposing sides of sidewalls 19 are adapted to interface with an external structure. In this one preferred embodiment, cap plate 18 is an approximately 3⅜ inches wide, approximately 11½ inches long, approximately four (4) inches in height (plate 18 and sidewalls 19) and approximately ⅛$^{th}$ of an inch thick plate. It is understood, that dimensions of plate 18 can vary depending upon the intended application that includes factors such as the width of beam 2, length, of beam 2, diameter of column 12 and load carried by beam 2.

Figure 10B:
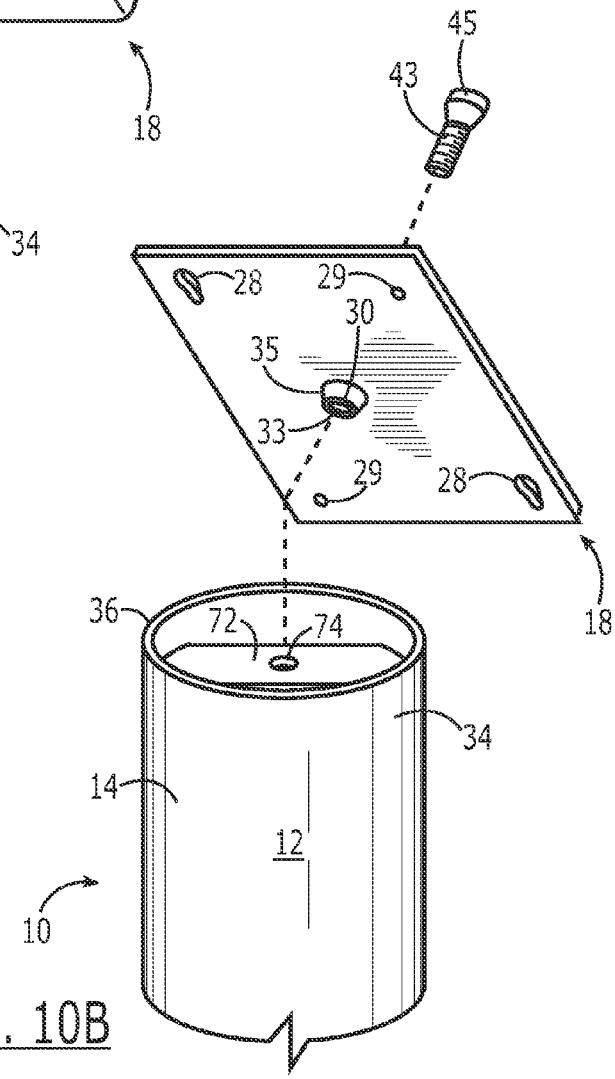
FIG. 10B is a top perspective view of the first end portion of the column and a second cap plate of the adjustable column of FIG. 9.

Referring now to FIGS. 9 and 10B, cap plate 18 of adjustable column 10 can also have a planar plate shape that defines at least two key hole type apertures 28 that are selective retention mechanisms for cap plate 18 with fasteners 32. In addition, cap plate 18 can selectively define one or more apertures 29 that are preferably circular shaped through holes.

In this one preferred embodiment, plate 18 includes a receptacle 30. Receptacle 30 defines an aperture 33 and has an approximately tapered countersink 35 type shape. Aperture 33 is approximately aligned with the central longitudinal axis of column 12 and is preferably unthreaded. Countersink 35 receives a bolt 43 that preferably has an approximately inch diameter. Bolt 43 has a flat countersink head 45 that mates with the corresponding tapered inside surface of countersink 35 such that a top of the flat head 45 of bolt 43 is approximately flush with the second side of plate 18.

The second side of cap plate 18 is adapted to interface with an external structure. In this preferred embodiment, cap plate 18 is a plate approximately 3⅛ inches wide, approximately eight (8) inches long and approximately ¼ of an inch thick, Key hole apertures 28 and one or more apertures 29 are the same as described previously above. It is understood that dimensions of plate 18 can vary depending upon the intended application that includes factors such as the width of beam 2, length of beam 2, diameter of column 12 and load carried by beam 2.

Figure 11:
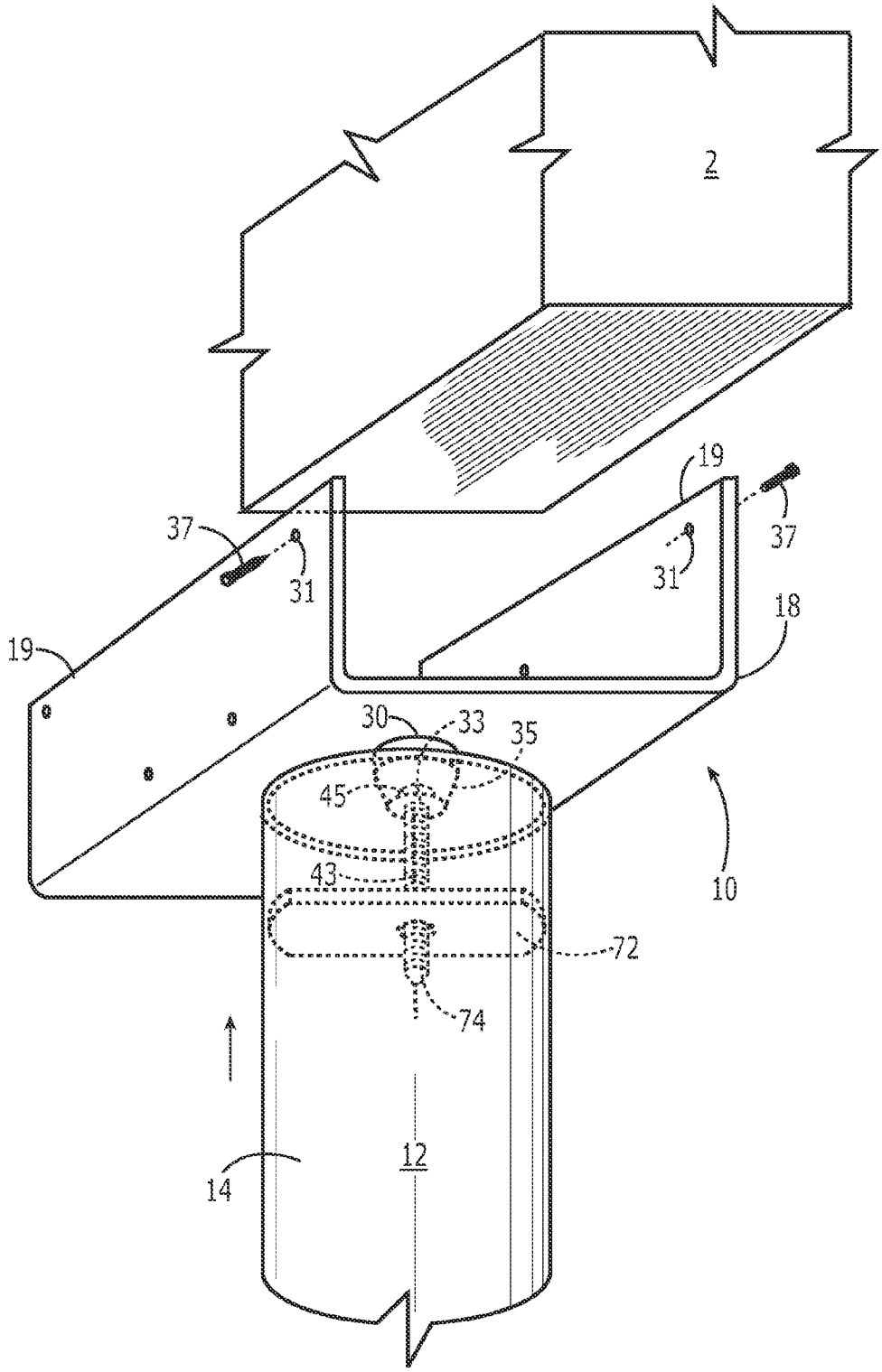
FIG. 11 is side perspective view of the first end portion of the column and first cap plate of the adjustable column aligned with and adapted to connect to a beam.
Figure 13:
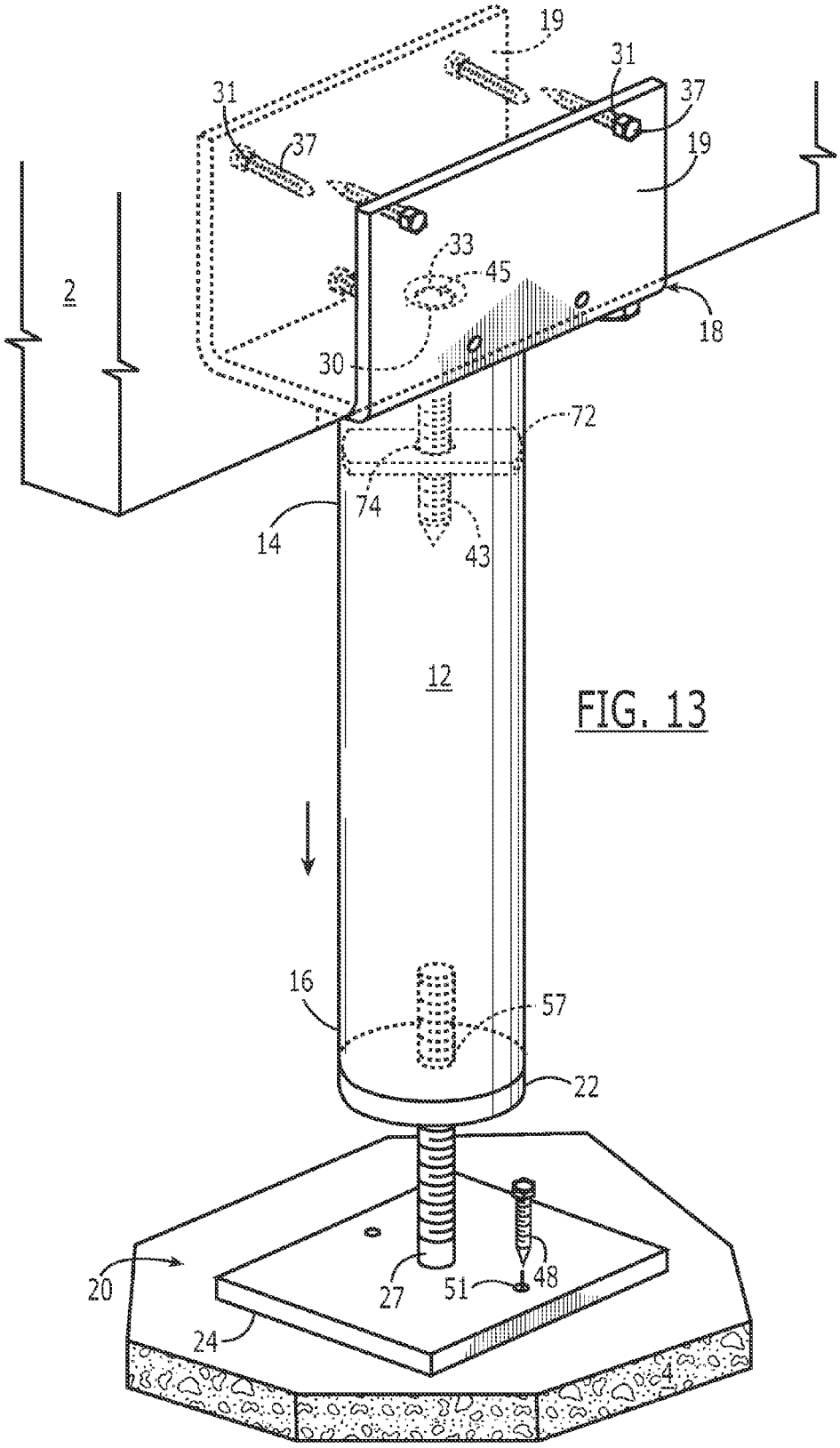
FIG. 13 is a side and top perspective view of the adjustable column that includes the first cap plate in position and adapted to support the beam.

As shown in FIGS. 11 and 13, threaded bolt 43 is positionable into countersink 33 and through aperture 33. Multi-sided bolt head 45 mates with the multi-sided receptacle 30 defined by countersink 35. Cap plate 18 bolt 43 is threaded into aperture 74 relative to plate 72. Bolt 43 secures cap plate 18 to plate 72 and first end portion 14 of column 12.

Assembled column 12 including adjustment mechanism 20 and cap plate 18 are adapted to be connected to beam 2 by positioning beam 2 between sidewalls 19 and using fasteners 37 to connect assembled column 12 and cap plate 18 to beam 2. Alternatively, cap plate 18 is adapted to be connected to beam 2 using fasteners 37 and column 12 plate 72 aperture 74 is connected to the downwardly extended bolt 43 of cap plate 18. Bolt 43 is fixed in position on plate 18 and is flush with second surface of base plate 18 that is adapted to abut beam 2. The multi-sided head 45 of bolt 43 and the mating multi-sided receptacle 30 of countersink 35 prevent the rotation of bolt 43 during the threaded connecting of plate 18 and aperture 74 of plate 72 in column 12.

In both of the above methods of installation of adjustable column 10 to beam 2, threaded bolt or rod 27 is turned relative to column 12 for the height adjustment of column 12. Rod or bolt 27 is adapted to adjust the height of column between floor 4 and beam 2. If plate 18 is initially installed on beam 2, then baseplate 24 can be fixed in position on floor 4 using bolts 48 through apertures 51 and column 12 rotated relative to bolt 27 to increase the height of column 12, threadingly engage aperture 74 of plate 72 with threaded bolt 43 and secure column 12 in a fixed load bearing position between floor 4 and beam 2.

If plate 18 is initially installed onto first end portion 14 of column 12, bolt 27 and base plate 24 are rotated to elevate column 12 and plate 18 is adapted to receive beam 2 between sidewalls 19. Once threaded rod 27 has been rotated sufficiently to secure adjustable column 10 in a load bearing position between floor 4 and beam 2, fasteners 37 are connected through apertures 31 in sidewalls 19 and fasteners 48 are connected through apertures 51 in base plate 24 and into floor 4.

Figure 12:
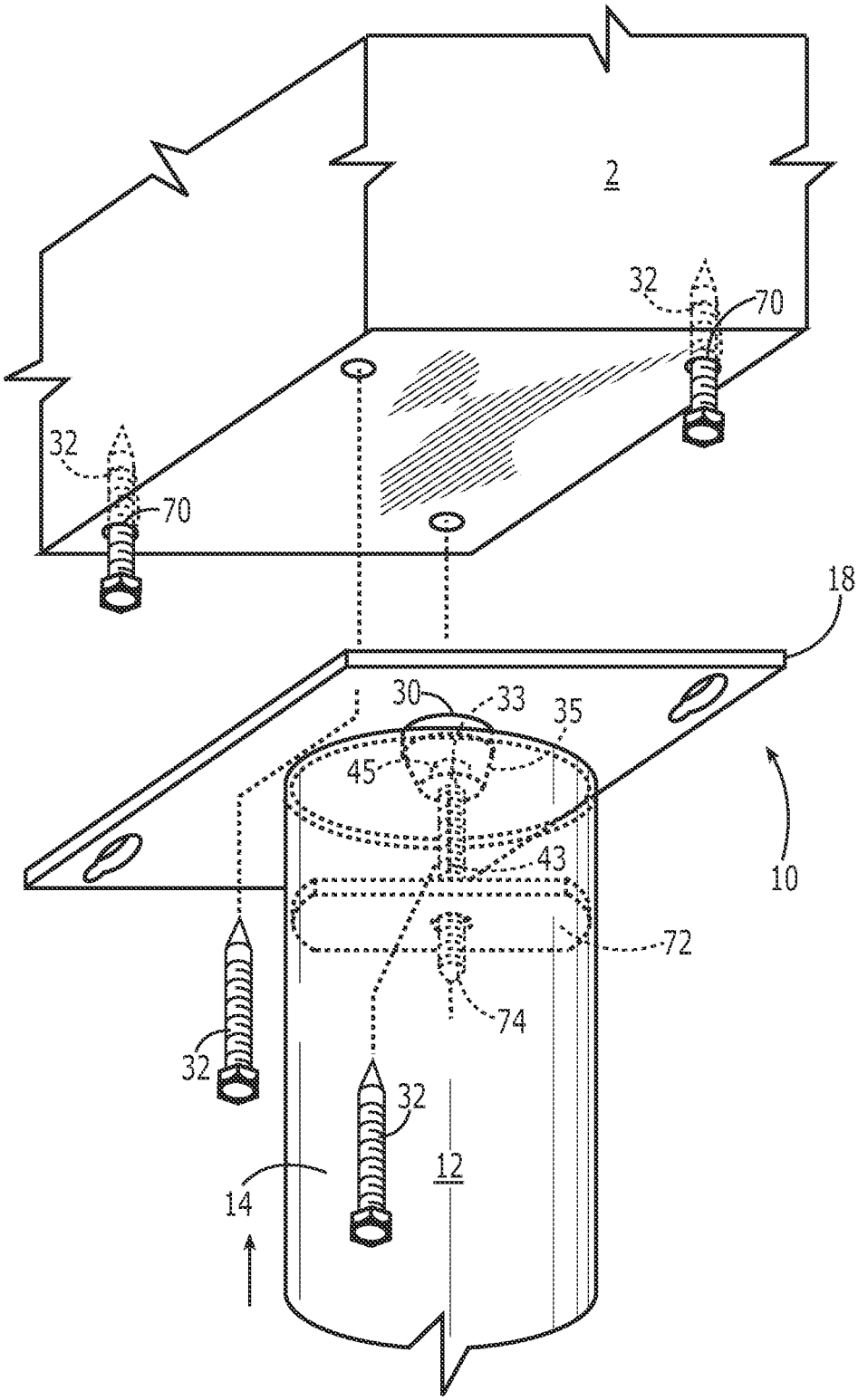
FIG. 12 is side perspective view of the first end portion of the column and second cap plate of the adjustable column aligned with and adapted to connect to the beam.
Figure 14:
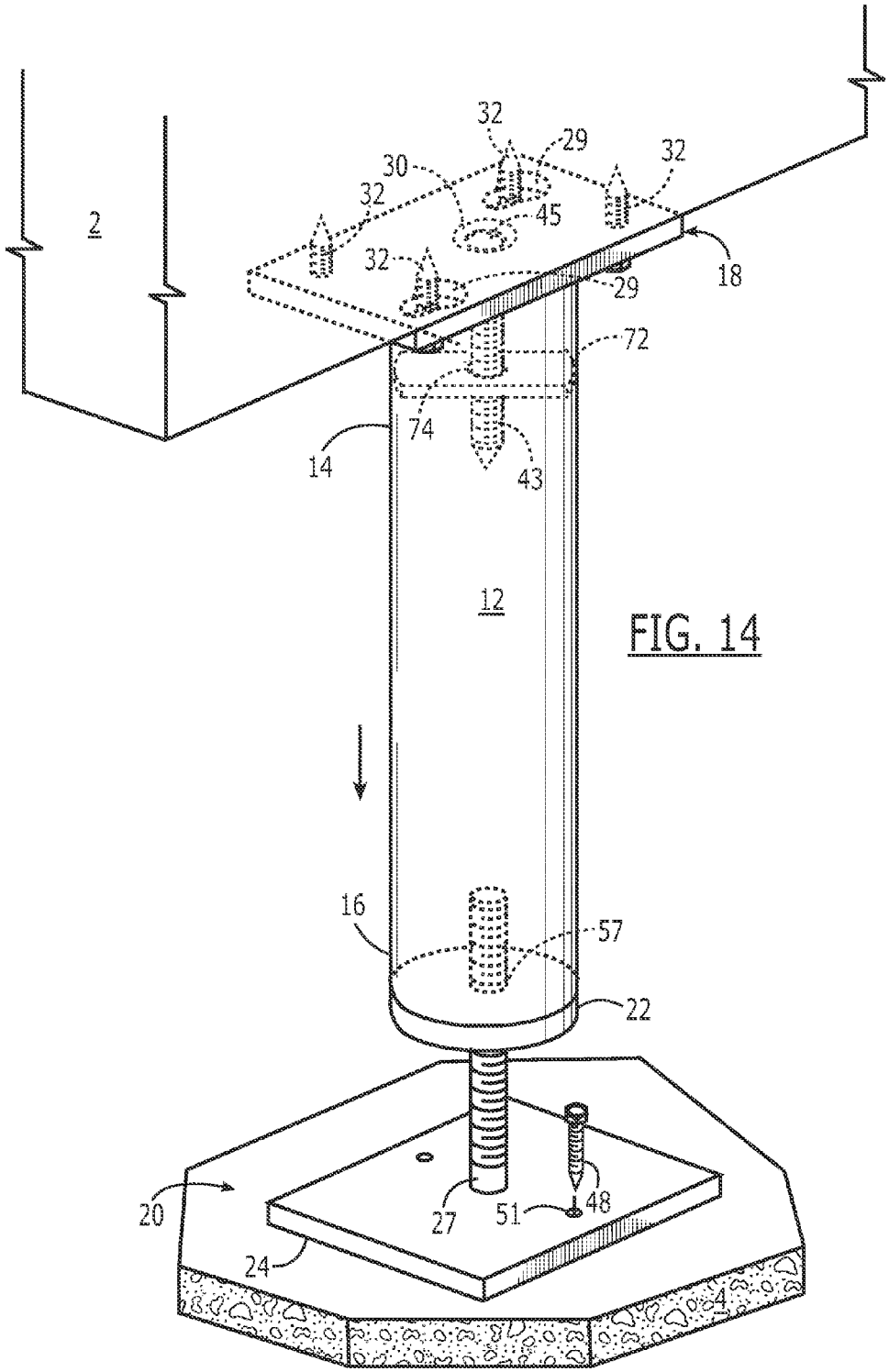
FIG. 14 is a side and top perspective view of the adjustable column that includes the second cap plate in position and adapted to support the beam.

Referring now to FIGS. 12 and 14, cap plate 18 is preferably assembled onto column 12 by positioning threaded bolt 43 into countersink 35 and threading bolt 43 into aperture 74 of plate 72 on first end portion 14 of column 12. The head 45 of bolt 43 in this embodiment includes a hex key receptacle that enables the turning and installation of countersunk head 45 into aperture 74 while positioned in countersink 35.

As described previously, the height of adjustment mechanism 20 is adjusted by turning rod 27 that interfaces with aperture 57 to change the height between base flange 22 and base plate 24. The height of distance between base flange 22 and base plate 24 is initially adjusted so that there is sufficient clearance between base plate 24 and a floor, such as a subfloor or floor 4, to accommodate the raising and connecting of adjustable column 10. In this preferred embodiment this can also include leaving sufficient height clearance for a lever to be inserted under adjustable column 10. It is understood that the load capacity and size of rod 27 can vary depending upon an intended application of adjustable column 10.

Adjustable column 10 is then raised and temporarily held in an approximately vertical position aligned with fasteners 32 in beam 2 as described previously in reference to FIGS. 5 and 6. A lever is positioned under adjustment mechanism 20 and actuated to raise adjustable column 10 to pass the heads of preferably two fasteners 32 through the first portions of key hole apertures 28 of cap plate 18. Adjustable column 10 is repositioned to secure the heads of fasteners 32 in the second portion of key holes 28. As required, a safety plug or adapter can be additionally inserted into the first portions of key hole 28 to ensure that adjustable column 10 does not shift during the installation process. Adjustable column 10 is then freely hanging from the connection of fasteners 32 with beam 2. Additional fasteners 32 are employed through the remaining apertures 28 and/or 29 of cap plate 18 to secure adjustable column 10 to beam 2 at a desired alignment.

In this preferred embodiment, rod 27 and base plate 24 are turned relative to column 12 to adjust the height of column 12. Adjustment mechanism 20, utilizing rod 27, is adapted to position adjustable column 10 in a load bearing position between floor 4 and beam 2.

Attachment mechanism 20 is adapted to secure column 12 to floor 4 by connecting fasteners 48 through apertures 51 in base plate 24. Once adjustable column 10 is fixed in a load bearing position between beam 2 and floor 4, it is understood that an additional concrete floor can be poured to encase adjustment mechanism 20 as shown and described previously in reference to FIG. 6. The encasing of adjustment mechanism 20 includes the area between plates 22 and 24 and preferably overlays fasteners 26 below the floor level. The encasing of adjustment mechanism 20 advantageously provides additional uplift protection, sets adjustable column 10 at a permanent height and precludes tampering.

Alternatively, base plate 24 of adjustment mechanism 20 can be positioned on and secured directly to floor 4. In this application, the gap between plates 22 and 24 can be filled with grout. Adjustment mechanism 20 can be further encased in concrete, as desired. As noted above, fasteners 48 are employed through apertures 51 in base plate 24 and directly into floor 4 to provide uplift protection.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example adjustment mechanism 20 can include alternative means for adjusting the height of column 12 such as a single threaded load bearing connector that couples with threaded connectors on base flange 22 and base plate 24 to adjust the height of adjustable column 10.

What is claimed is:

1. An adjustable column that comprises:

a tubular column that has a first end portion and an opposed second end portion, the first end portion includes a column plate, the column plate connected to the inside of the tubular walls of the column and recessed below a rim of the first end portion of the column, the column plate defines an aperture;

a cap plate that has a first side and an opposed second side, the first side fixed to the column and the opposed second side adapted to interface with a beam, the cap plate defines a receptacle that is a countersink, the countersink defines a first aperture, a first fastener with a countersink head is received by and mates with the countersink in the cap plate, the first fastener installed in the countersink of the cap plate includes a top of the head of the first fastener approximately flush with the second side of the cap plate, the cap plate adapted to secure the column to the beam, the cap plate defines second apertures and includes second fasteners positionable in the second apertures, the second fasteners adapted to secure the cap plate to the beam;

an adjustment mechanism that connects to the second end portion of the column, the adjustment mechanism includes a base plate, a base flange and a threaded rod, the base plate fixedly connected to the threaded rod, the base flange defines a threaded aperture that connects with the threaded rod to adjust the height of the column, the base plate adapted to be positioned on a floor, the base flange connected to the second end portion of the column, the head of the first fastener is received by and mates with the countersink, the cap plate adapted to be connected to the beam, the first fastener connects to the first aperture in the column plate, the column suspended from the first fastener, the second end portion of the column adapted to provide an adjustable load bearing interface between the floor and a terminal end of the second end portion of the column, the adjustment mechanism adjusts to extend between the suspended column and the floor, the extended adjustment mechanism adapted to place the column in a load bearing position between the beam and floor.

2. The adjustable column of claim 1, wherein the cap plate includes a base that is connected to two approximately parallel sidewalls, the cap plate has an approximately U-shape that is adapted to receive the beam between the sidewalls.

3. The adjustable column of claim 1, wherein the countersink in the cap plate defines multi-sided walls and the head of the fastener has mating multi-sided walls, the countersink engages and fixes the first fastener from rotational movement in the countersunk receptacle.

4. The adjustable column of claim 2, wherein the second apertures are defined in the sidewalls of the cap plate.

5. The adjustable column of claim 1, wherein the cap plate is an elongate flat plate that defines a receptacle that is a tapered countersink and the countersink defines a first aperture, the cap plate further includes a first threaded fastener, the first threaded fastener has a flat countersunk head that mates with the countersink in the cap plate, a top of the head of the first fastener flush with the second side of the cap plate.

6. The adjustable column of claim 5 that further includes a selective retention mechanism, the selective retention mechanism includes at least one aperture with a varying cross-sectional area defined in the cap plate and at least one fastener, the at least one aperture has a first portion with a first cross-sectional area and a second portion with a second cross-sectional area, the first cross-sectional area is larger than the second cross-sectional area, the at least one fastener includes a shaft and a head, the head of the fastener fits through the larger first portion of the apertures and the head of the fastener cannot fit through the smaller second portion of the apertures, the at least one fastener adapted to connect to the beam, the head of the at least one fastener fits through the first portion of the at least one aperture in the cap plate and the column moved to align the head of the fastener with the second portion of the at least one aperture, the column suspended from the at least one fastener, the second end portion of the column is adapted to provide an adjustable load bearing interface between the floor and a terminal end of the second end portion of the column, the adjustment mechanism adjusts to extend between the suspended column and the floor, the extended adjustment mechanism adapted to place the column in a load bearing position between the beam and floor.

7. The adjustable column of claim 1, wherein the cap plate includes a support structure and the support structure is adapted to connect the cap plate to the beam.

8. The adjustable column of claim 1, wherein the base plate is adapted to be extended to a position on the floor in alignment with the suspended column, extending the adjustment mechanism includes positioning the column in the load bearing position, the base plate including screws, the screws adapted to secure the base plate to the floor.

9. The adjustable column of claim 1, wherein the base flange defines a threaded aperture and a threaded rod is fixedly connected to the base plate, the threaded rod adjustable relative to the base flange, the rod provides a load bearing interface between the base flange and base plate.

10. The adjustable column of claim 1, wherein uplift protection is provided by fasteners that extend through apertures in the base plate and the fasteners adapted to connect the base plate to the floor and fasteners that extend through apertures in the cap plate and the fasteners adapted to connect the cap plate to the beam.

11. A method of adjusting the height of a column comprising the steps of:

providing a column, a cap plate and an adjustment mechanism, the column includes a column plate recessed below a rim of a first end portion of the column, the column plate defines an aperture;

connecting a first end portion of the column to the cap plate, the cap plate includes a first fastener that connects the cap plate and the column plate and at least two fasteners adapted to connect the cap plate to the beam;

connecting the adjustment mechanism to a second end portion of the column; raising the assembled column and cap plate and connecting the assembled column and cap plate to the beam and suspending the column from the first fastener of the cap plate; and adjusting the height of the adjustment mechanism such that the suspended adjustable column is moved between a suspended position and a load bearing position between the beam and a floor.

12. The method of adjusting the height of a column of claim 11 that further includes a single worker performing the steps of connecting, raising and adjusting the height of the adjustment mechanism.

13. The method of adjusting the height of a column of claim 11 wherein the step of adjusting the height of the adjustment mechanism further includes adjusting the height between a base flange and a base plate of the adjustment mechanism using a single threaded load bearing fastener to position the adjustable column in the load bearing position.

* * * * *